US012729858B2

(12) United States Patent
Zhang et al.

(10) Patent No.: US 12,729,858 B2
(45) Date of Patent: Sep. 8, 2026

(54) STOVE WITH FOLDABLE FUNCTION

(71) Applicant: HUOXIONG GUANGZHOU TECHNOLOGY COMPANY LIMITED, Guangzhou (CN)

(72) Inventors: Liang Zhang, Foshan (CN); Yue Dong, Shanghai (CN)

(73) Assignee: HUOXIONG GUANGZHOU TECHNOLOGY COMPANY, Guangzhou (CN)

( * ) Notice: Subject to any disclaimer, the term of this patent is extended or adjusted under 35 U.S.C. 154(b) by 326 days.

(21) Appl. No.: 18/340,871

(22) Filed: Jun. 25, 2023

(65) Prior Publication Data

US 2024/0418373 A1 Dec. 19, 2024

(30) Foreign Application Priority Data

Jun. 13, 2023 (CN) ..... 202321496047.2

(51) Int. Cl.
*F24B 1/181* (2006.01)
*F24B 1/192* (2006.01)
*F24B 1/195* (2006.01)

(52) U.S. Cl.
CPC ..... *F24B 1/181* (2013.01); *F24B 1/192* (2013.01); *F24B 1/195* (2013.01)

(58) Field of Classification Search
CPC ..... F24B 1/181; F24B 1/192; F24B 1/195
See application file for complete search history.

(56) References Cited

U.S. PATENT DOCUMENTS 4,455,992 A * 6/1984 Hsiao ..... F24B 1/205 126/9 R
5,832,915 A * 11/1998 Skidmore ..... A47J 37/0763 126/25 R
6,286,503 B1 * 9/2001 Bach ..... F24B 1/181 126/9 B
6,321,640 B1 * 11/2001 Tseng ..... A47J 37/0786 99/449
6,802,312 B1 * 10/2004 Kuelbs ..... F24B 1/192 126/519
2006/0037605 A1 * 2/2006 Fitzgerald ..... F24B 1/181 126/519
2012/0318255 A1 * 12/2012 Brown ..... F23B 20/00 126/25 R (Continued)

FOREIGN PATENT DOCUMENTS

CN 104390209 A 3/2015
CN 210951390 U 7/2020
CN 215637392 U 1/2022

*Primary Examiner* — Alfred Basichas

(57) ABSTRACT

A stove with foldable function, comprising a base and a mesh screen, wherein the base is equipped with an ashtray, and the mesh screen comprises a front side panel, a left side panel, a rear side panel, and a right side panel. The lower ends of the front side panel and the rear side panel are pivotally connected to the base; The front edge of the left panel is connected to the front side panel, and the rear edge of the left panel is equipped with a first locking mechanism with the rear side panel; The front edge of the right side panel is connected to the front side panel, and a second locking mechanism is set between the rear edge of the right side panel and the rear side panel. There is a spacer between the rear side panel and the base.

9 Claims, 8 Drawing Sheets

(56) References Cited

U.S. PATENT DOCUMENTS

| | | | | |
|---|---|---|---|---|
| 2018/0055280 | A1* | 3/2018 | Artig | A47J 33/00 |
| 2018/0372324 | A1* | 12/2018 | Gamble | A45F 4/00 |
| 2023/0204218 | A1* | 6/2023 | Thibault | A47J 37/0704 126/9 B |

* cited by examiner

STOVE WITH FOLDABLE FUNCTION

CROSS-REFERENCE TO RELATED APPLICATIONS

The application claims priority to Chinese patent application No. 2023214960472, filed on Jun. 13, 2023, the entire contents of which are incorporated herein by reference.

TECHNICAL FIELD

This disclosure relates to a stove with foldable function.

BACKGROUND

The statement herein only provides background information related to the present invention and does not necessarily constitute prior art.

As people's living standards continue to improve, outdoor activities are becoming more and more popular, and using a stove to warm up has become an indispensable part of people's outdoor activities. The traditional stove is assembled as a complete unit in the factory. Although the stove frame can be folded, the overall volume of the stove body is still large, making it difficult to carry and store. Additionally, existing foldable stoves typically have a small combustion chamber and limited space for storing firewood. While some stoves are designed with a modular assembly, they still have some inconvenience during use. Moreover, some stoves allow ash to fall on the ground after burning wood, causing damage to the surrounding environment.

For this reason, it is necessary to study a new technical solution to solve the above problems.

SUMMARY

To address the shortcomings of existing technologies, the present invention provides a stove with foldable function. Through a specific folding design, this stove is easier and less time-consuming to fold and unfold compared to modular portable stoves. Additionally, the use of spacers ensures a flat surface after folding. Furthermore, the stove includes a drawer-type ashtray that solves the issue of damage to the ground environment and is also easier to clean.

To achieve the above objectives, the present invention adopts the following technical solution:

A stove with foldable function comprises of a base and a mesh screen arranged on the base, wherein an ashtray is arranged inside the base, the ashtray has an ash chamber, the base is provided with an isolation net above the ash chamber, and the lower side of the base can be folded and connected with a supporting leg;

The mesh screen comprises a front side panel, a left side panel, a rear side panel, and a right side panel, which are sequentially connected to form a combustion chamber on the upper part of the base: The front side panel and rear side panel are arranged parallel to each other, and the lower edges of both are pivotally connected to the base; The left side panel and the right side panel are arranged parallel to each other, and the front side edge of the left side panel is pivotally connected to the left side edge of the front side panel, and a first locking mechanism is arranged on the rear side edge of the left side panel and the left side edge of the rear side panel: The front side edge of the right side panel is pivotally connected to the right side edge of the front side panel, and a second first locking mechanism is arranged on the rear side edge of the right side panel and the right side edge of the rear side panel. The front side panel, left side panel, rear side panel, and right side panel are all provided with mesh holes;

Furthermore, a spacer is arranged between the lower edge of the rear side panel and the base.

In some embodiments, it also includes an upper cover plate located on the upper side of the mesh screen, wherein a pair of side edges of the upper cover plate extend downwards with a locking groove adapted to the opening on the upper side of the mesh screen, and a handle extends outwards on a pair of side edges of the upper cover plate.

In some embodiments, the length of the front and rear side panels is the same, the length of the left and right side panels is the same, and the length of the front side panel is greater than the length of the left side panel. The front side panel, rear side panel, left side panel, and right side panel form a rectangle around them.

In some embodiments, the ashtray drawer is arranged on the base.

In some embodiments, the ashtray is provided with a grip.

In some embodiments, the inner side of the base is equipped with a guide slope corresponding to the ashtray:

In some embodiments, the base is provided with an air inlet.

In some embodiments, the base, mesh screen, and upper cover plate are all hardware components.

In some embodiments, the first locking mechanism includes a first locking hole arranged on the left side panel, a second socket arranged on the rear side panel, and a first locking pin arranged on the rear side panel that connects the two holes: The second locking mechanism includes a third locking hole arranged on the right side panel, a fourth locking hole arranged on the rear side panel, and a second locking pin arranged on the rear side panel that connects the two holes.

Compared with the prior art, the present invention has significant advantages and beneficial effects. Specifically, as can be seen from the above technical solution, the main advantage of the foldable design of the stove is that it is more convenient and time-saving to fold and unfold compared to the assembled portable stove. Additionally, the stove includes a spacer to ensure its flatness after folding. Secondly, the specific design of the ashtray and the base ensure the stove has accurate ash landing and easy cleaning advantages.

In order to more clearly illustrate the structural features and functions of the present invention, the following is a detailed description of the present invention in conjunction with the accompanying drawings and specific embodiments.

DESCRIPTION OF THE KEY IN THE DRAWINGS

10. Mesh screen; 11. Front side panel; 12. Left side panel; 121. First locking hole; 13. Rear side panel; 131. Second locking hole; 14. Right side panel; 15. First locking pin; 16. Second locking pin; 17. Upper cover plate; 171. Locking groove; 172. Handle; 20. Base; 21. Isolation net; 22. Supporting leg; 23. spacer; 24. Guide slope; 25. Air inlet; 30. ashtray; 31. Grip.

DETAILED DESCRIPTION OF THE EMBODIMENTS

The following will provide a clear and complete description of the technical solution in this embodiment of the present invention in conjunction with the accompanying drawings, and it is clear that the described embodiment is only a preferred embodiment of the present invention.

It should be noted that when a component is referred to as "fixed to" another component, it may be directly attached to another component or there may be a centered component. When a component is considered to be "connected to" another component, it may be directly connected to another component or there may also be a centered component. The terms "vertical", "horizontal", "left", "right", and similar expressions used in this article are for illustrative purposes only and do not necessarily represent the exclusive implementation method.

Unless otherwise defined, all technical and scientific terms used in this article have the same meanings as those commonly understood by those skilled in the technical field of the present invention. The terms used in the specification of the present invention in this article are only for the purpose of describing specific embodiments and are not intended to limit the present invention. The term "and/or" used in this article includes any and all combinations of one or more related listed items.

Figure 1:
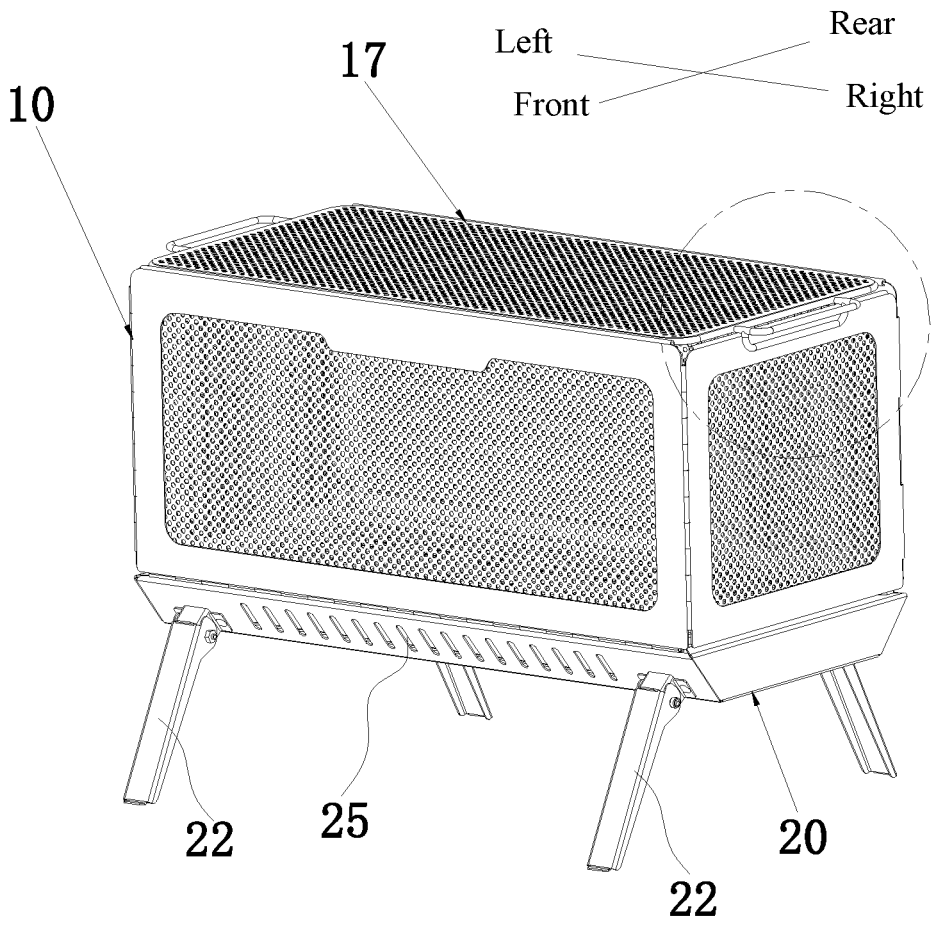
FIG. 1 shows a three-dimensional schematic diagram of an embodiment of the present invention.
Figure 2:
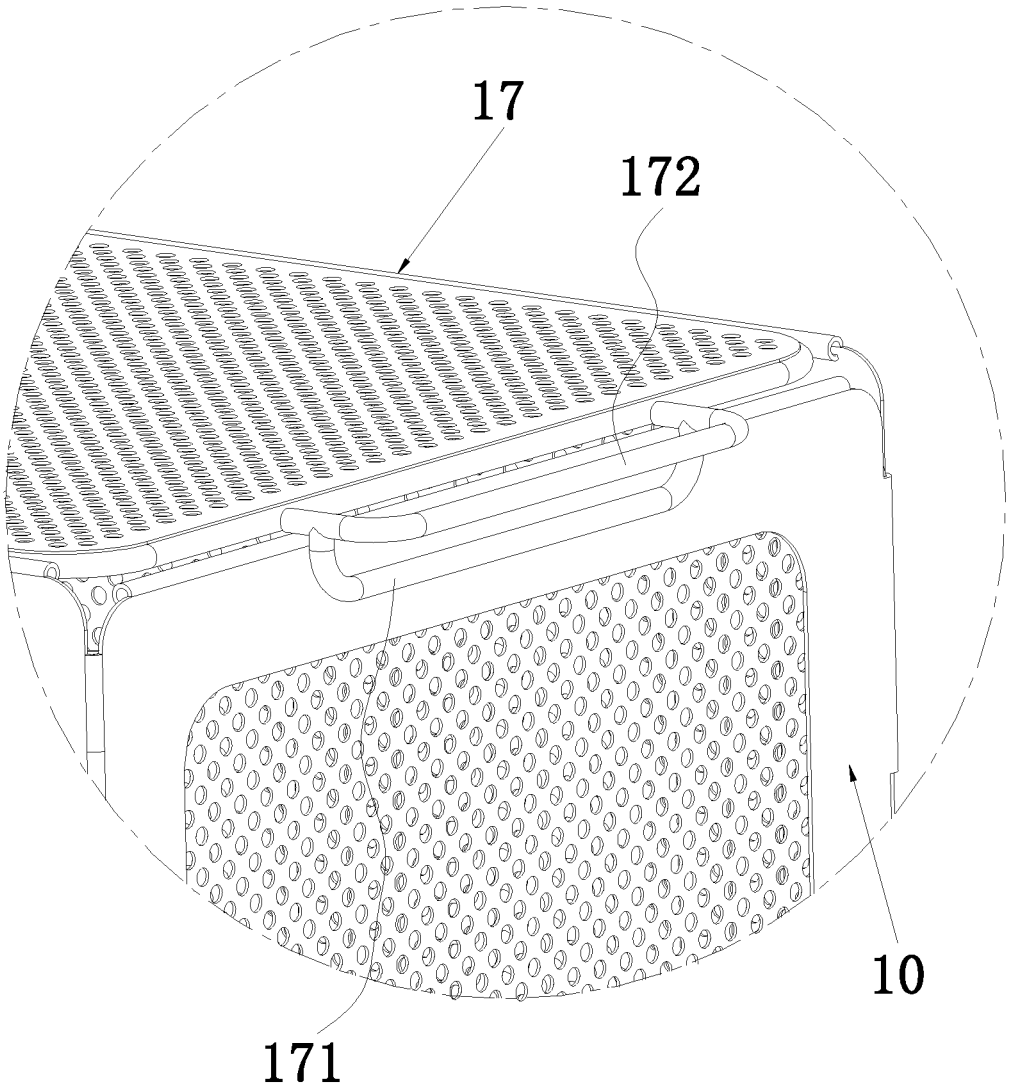
FIG. 2 shows a partially enlarged view of FIG. 1.
Figure 3:
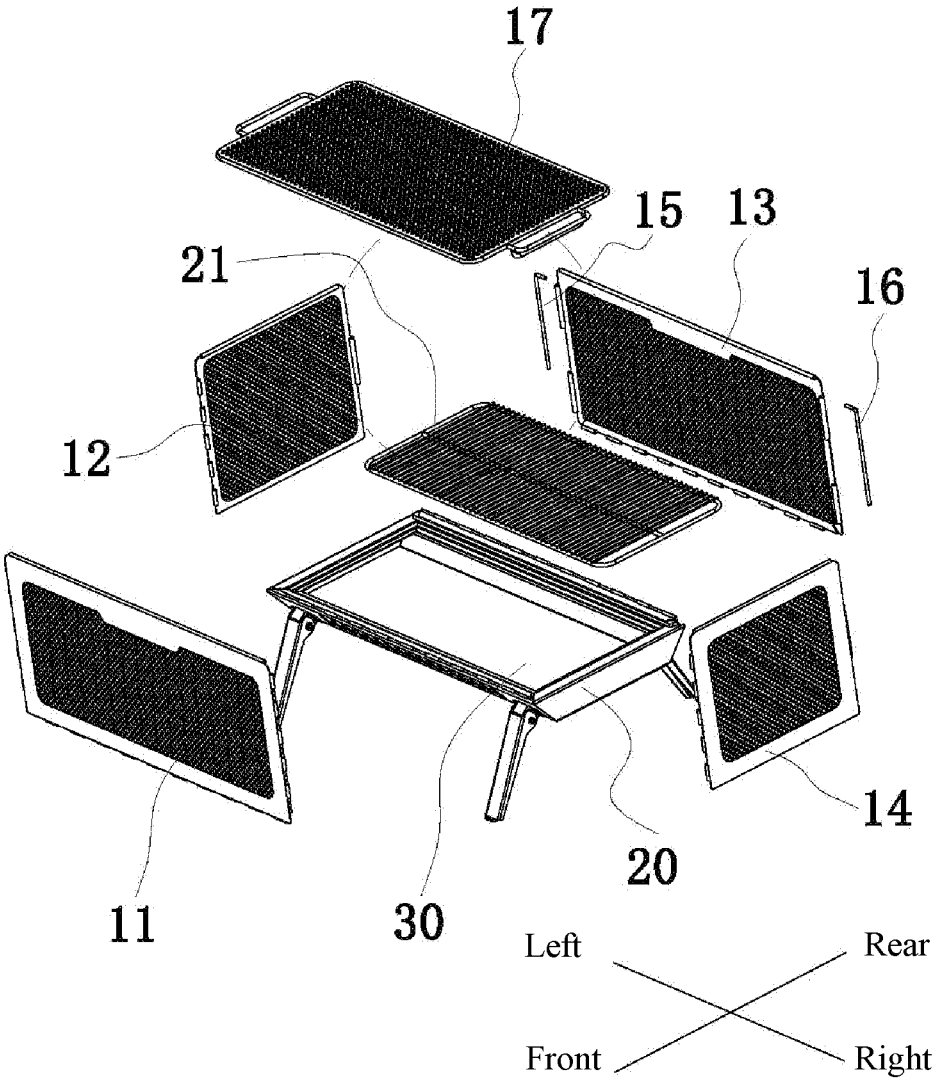
FIG. 3 shows a first exploded schematic diagram of an embodiment of the present invention.
Figure 4:
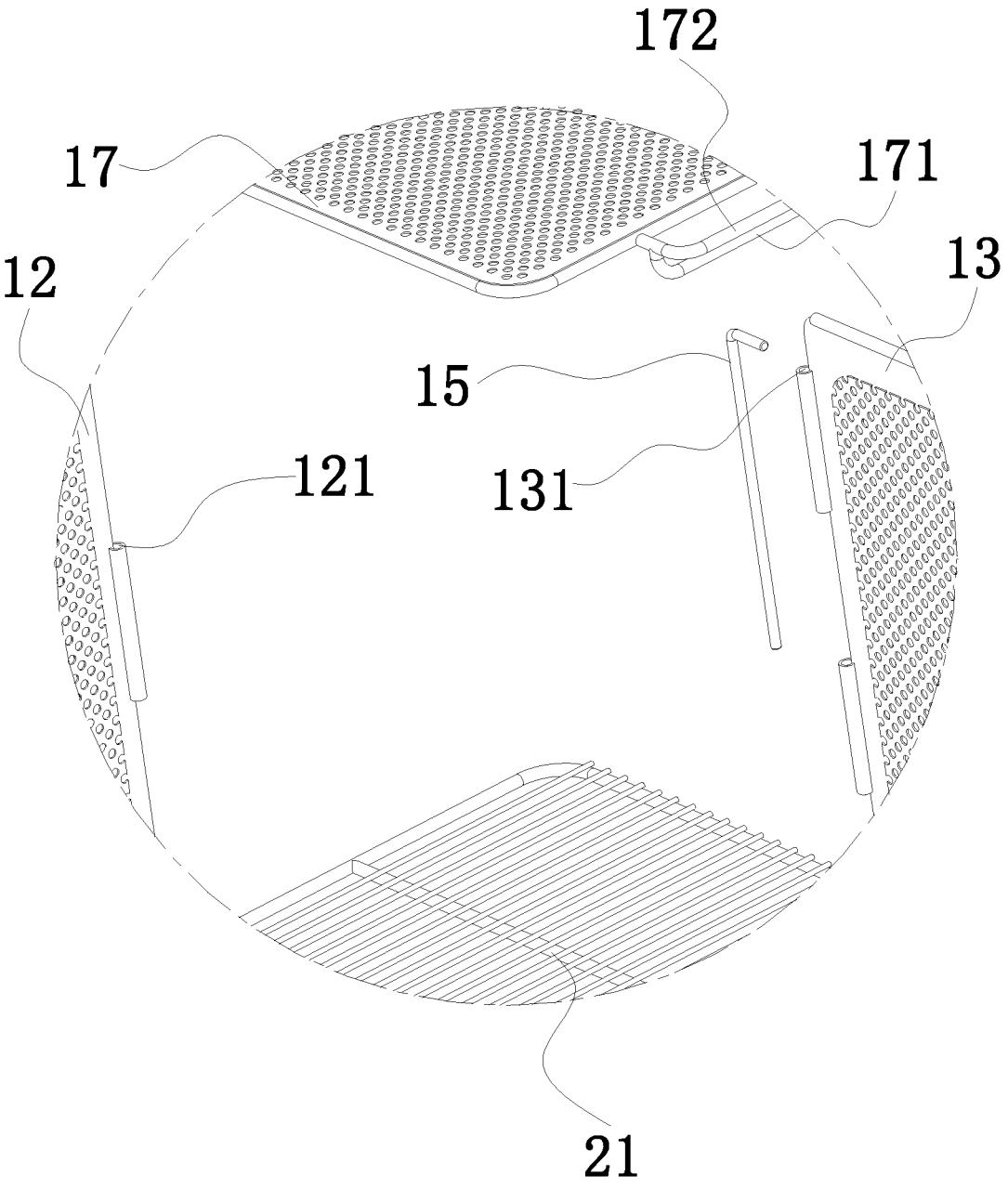
FIG. 4 shows a partially enlarged view of FIG. 3.
Figure 5:
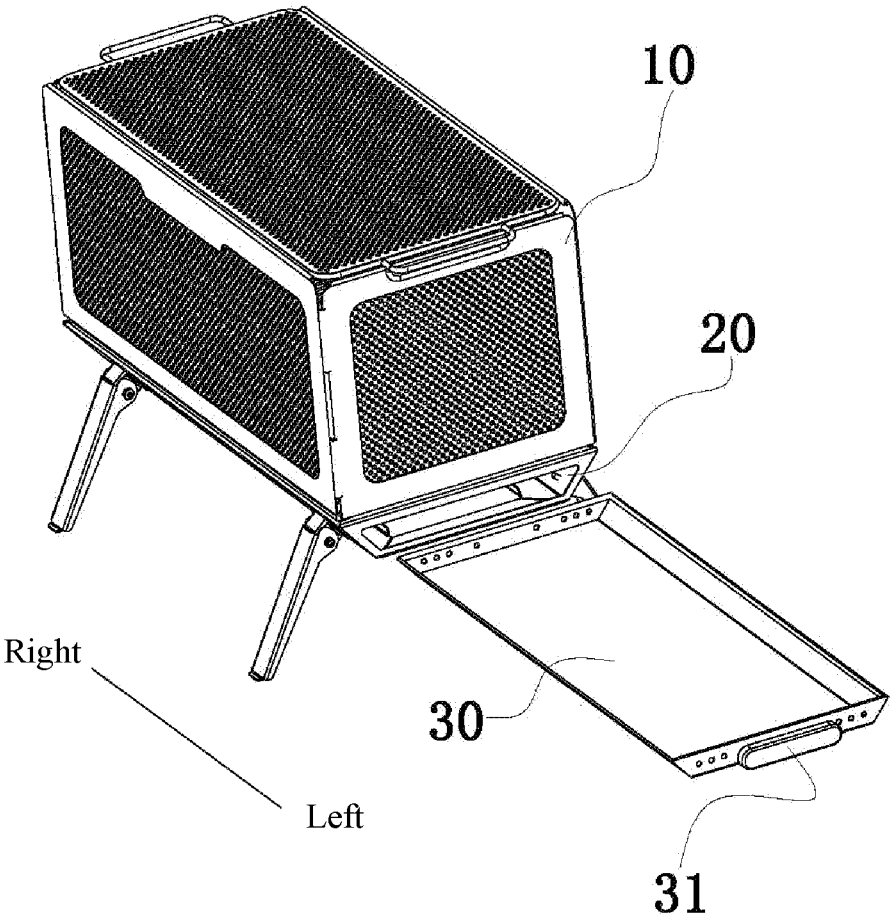
FIG. 5 shows a second exploded schematic diagram of an embodiment of the present invention.
Figure 6:
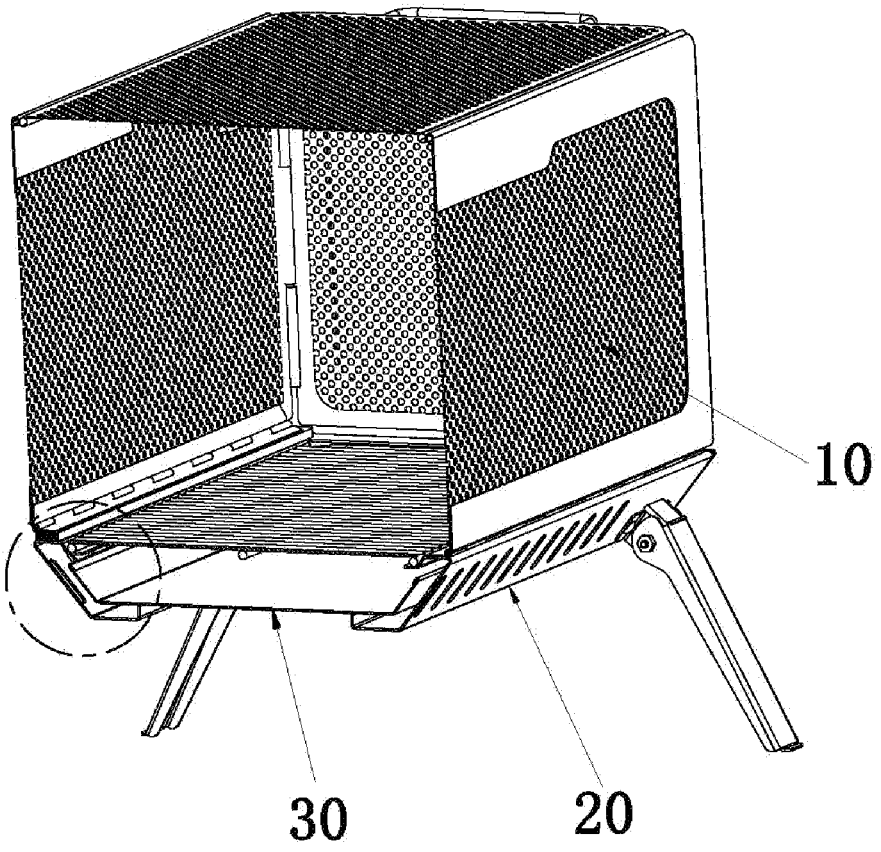
FIG. 6 shows the cross-sectional schematic diagram of an embodiment of the present invention.
Figure 7:
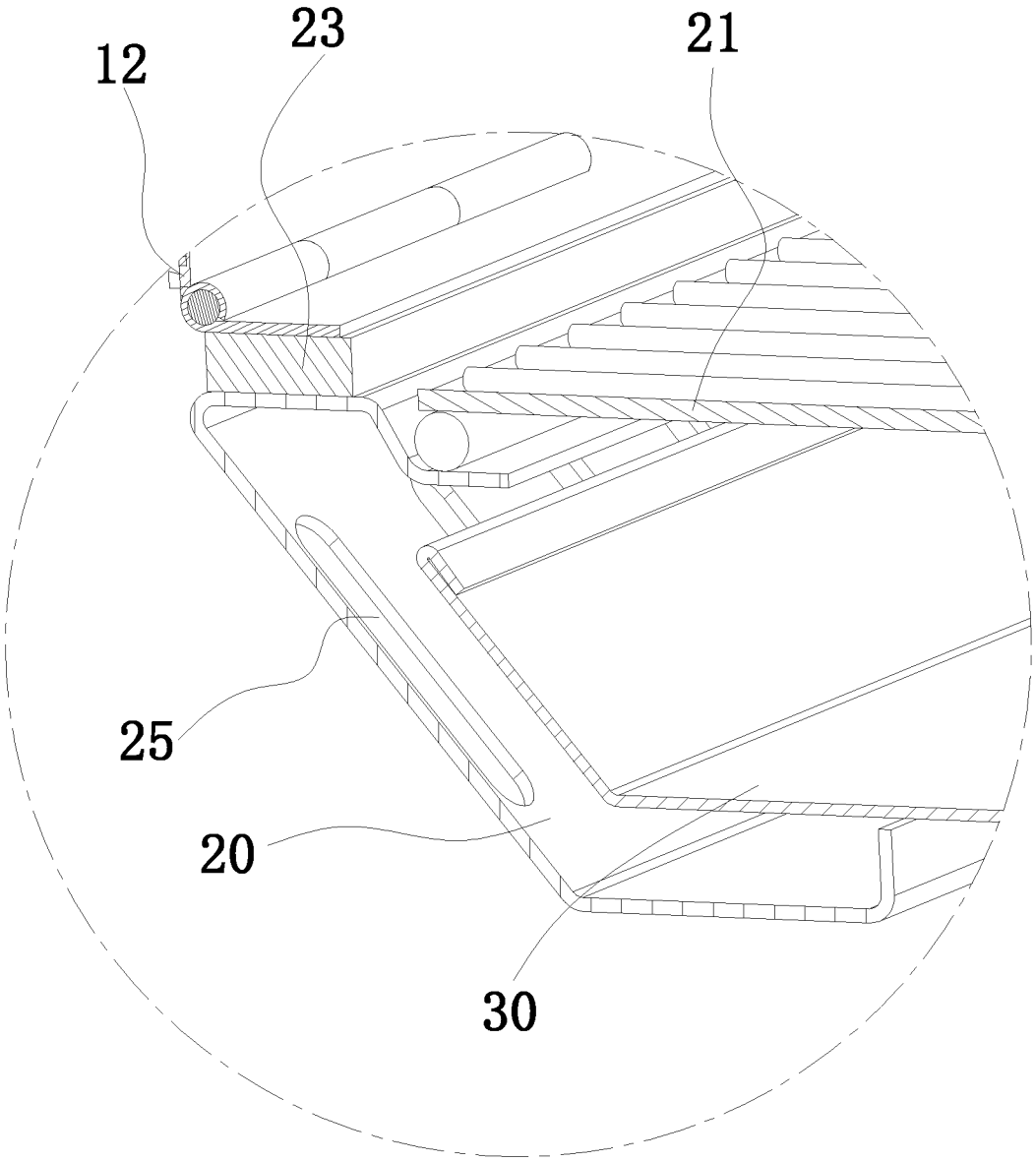
FIG. 7 shows a partially enlarged view of FIG. 6.
Figure 8:
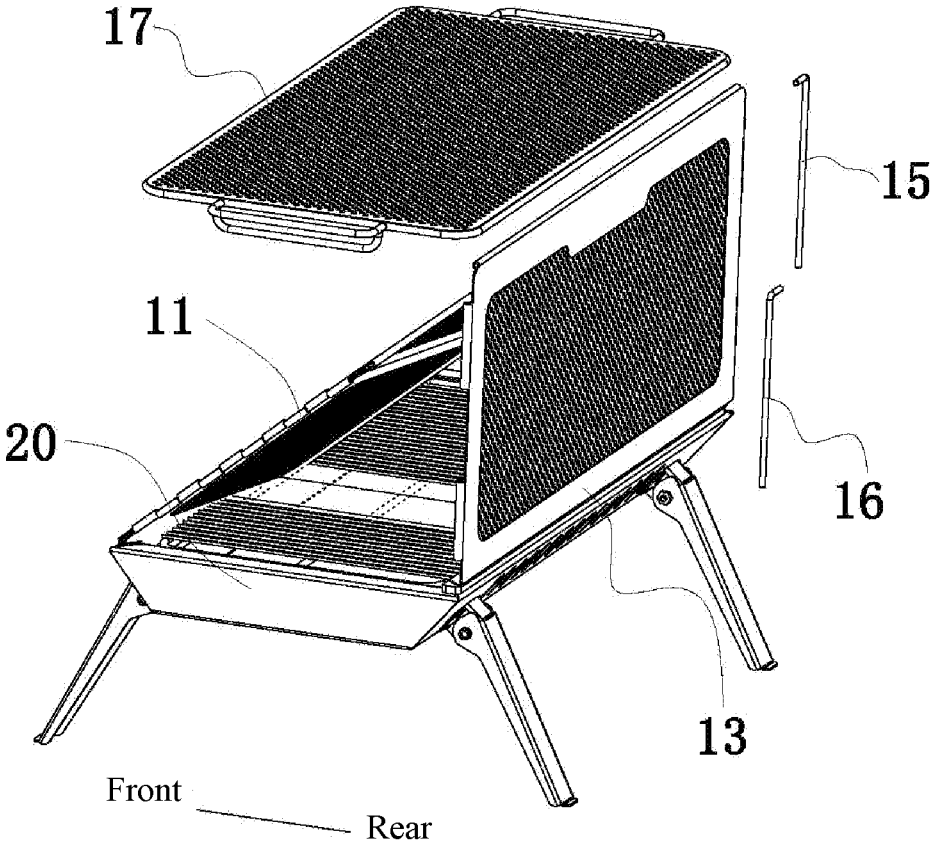
FIG. 8 is a schematic diagram of the folding and storage process of an embodiment of the present invention.

Referring to FIG. 1 to FIG. 8, in the embodiment of the present invention, a stove with foldable function includes a base 20 and a mesh screen 10 arranged on the base 20. The base 20 is provided with an ashtray 30, which has an ash chamber. The base 20 is provided with an isolation net 21 above the ash chamber, and the lower side of the base 20 can be folded and connected with the supporting leg 22;

The mesh screen 10 includes a front side panel 11, a left side panel 12, a rear side panel 13, and a right side panel 14, which are sequentially connected to form a combustion chamber above the base 20; The front side plate 11 and the rear side plate 13 are arranged in parallel with each other, and the lower edges of both are pivotally connected (a hinge structure can be used) to the base 20; The left side plate 12 and the right side plate 14 are arranged in parallel with each other, and the front side edge of the left side plate 12 is pivotally connected (a hinge structure can be used) to the left side edge of the front side plate 11, and the rear side edge of the left side plate 12 and the left side edge of the rear side plate 13 are provided with a first locking mechanism: The front side edge of the right side plate 14 is pivotally connected to the right side edge of the front side plate 11, and a second locking mechanism is arranged between the rear side edge of the right side plate 14 and the right side edge of the rear side plate 13. Additionally, the front side plate 11, left side plate 12, rear side plate 13, and right side plate 14 are all provided with mesh holes: A spacer 23 is also arranged between the lower edge of the rear side plate 13 and the base 20.

Specifically, the first locking mechanism includes a first locking hole 121 arranged on the left side panel 12, a second locking hole 131 arranged on the rear side panel 13, and a first pin 15, and the three are adapted: The second locking mechanism includes a third locking hole arranged on the right side plate 14, a fourth locking hole arranged on the rear side plate 13, and a second locking pin 16, and the three are adapted. The lower edge of the front side plate 11 is usually connected to the base 20 through a rotating shaft structure (hinge), and the lower edge of the rear side plate 13 is usually connected to the base 20 through a rotating shaft structure (hinge).

When storing, open the first locking mechanism, and the rear side plate 13 and left side plate 12 are separated. Open the second locking mechanism, and the rear side plate 13 and right side plate 14 are separated. Then, rotate the left side plate 12 around the left side of the front side plate 11 and store it in the front side plate 11. Rotate the right side plate 14 around the right side of the front side plate 11 and store it in the front side plate 11 to form a front storage group: Next, fold the front storage group backward around the lower side direction of the front side panel 11 onto the base 20, and fold the rear side panel 13 forward around its lower side direction onto the base 20; Finally, fold the supporting leg 22 onto the lower side of the base 20 to complete folding and storage.

The stove of this application can be unfolded and used by opening it in the opposite order of storage. Therefore, through the specific design, the stove has the advantages of being easier and quicker to fold and unfold than existing stove designs that rely on assembly: A spacer 23 is also provided on the lower side of one of the side panels to further ensure that the stove is flat after being folded.

Furthermore, it also includes an upper cover plate 17 covered on the upper side of the mesh screen 10, wherein a pair of side edges of the upper cover plate 17 extend downwards with a locking groove 171 adapted to the opening on the upper side of the mesh screen 10, and a handle 172 extends outwards on a pair of side edges of the upper cover plate 17. In this way, by setting an upper cover plate 17 to seal the upper opening of the mesh screen 10, it not only avoids large sparks flying out of the combustion chamber from the upper side, improves safety, but also ensures the purpose of observing the fire; Preferably, the upper cover plate 17 is also provided with mesh holes; At the same time, a locking groove 171 is arranged on the upper cover plate 17 to further fix the mesh screen 10. Moreover, the extended handle 172 can facilitate users to open the upper cover plate 17 and add fuel, and enhance safety.

Usually, the lengths of the front side panel 11 and the rear side panel 13 are the same, while the lengths of the left side panel 12 and the right side panel 14 are the same. The length of the front side panel 11 is greater than the length of the left side panel 12, and the four sides of the front side panel 11, rear side panel 13, left side panel 12, and right side panel 14 form a rectangle.

Preferably, the drawer type ashtray 30 is arranged on the base 20 to facilitate user operations such as ash cleaning. Preferably, the ashtray 30 is provided with a grip 31. Furthermore, the inner side of the base 20 is provided with a guide slope 24 corresponding to the ashtray 30, which makes it more convenient for the ash inside the base 20 to fall into the ashtray 30.

Furthermore, the base 20 is equipped with an air inlet 25, which ensures the combustion efficiency of combustibles (usually combustible wood) in the combustion chamber. Preferably, the air inlet 25 is arranged on one side of the base 20 to improve convection effect and gas flow rate. In this embodiment, the air inlet 25 is arranged on the front and rear sides of the base 20.

Usually, the base 20, mesh screen 10, and upper cover plate 17 are all hardware components. Specifically, the mesh holes on the front side panel 11, left side panel 12, rear side panel 13, and right side panel 14 can be processed by laser or mold, and can be formed by welding the wire mesh to the frame.

The main advantage of the foldable design of the stove is that it is more convenient and time-saving to fold and unfold compared to the assembled portable stove. Additionally, the stove includes a spacer to ensure its flatness after folding. Secondly, the specific design of the ashtray and the base ensure the stove has accurate ash landing and easy cleaning advantages.

The above is only a preferred embodiment of the present invention and does not limit the technical scope of the present invention, so any minor modifications, equivalent changes, or modifications made to the above embodiments based on the technical essence of the present invention still fall within the scope of the technical solution of the present invention.

What is claimed is:

1. A stove with foldable function is characterized in that it comprises of a base and a mesh screen arranged on the base, wherein an ashtray is arranged inside the base, the ashtray has an ash chamber, the base is provided with an isolation net above the ash chamber, and the lower side of the base can be folded and connected with a supporting leg:

The mesh screen comprises a front side panel, a left side panel, a rear side panel, and a right side panel, which are sequentially connected to form a combustion chamber on the upper part of the base; The front side panel and rear side panel are arranged parallel to each other, and the lower edges of both are pivotally connected to the base; The left side panel and the right side panel are arranged parallel to each other, and the front side edge of the left side panel is pivotally connected to the left side edge of the front side panel, and a first locking mechanism is arranged on the rear side edge of the left side panel and the left side edge of the rear side panel; The front side edge of the right side panel is pivotally connected to the right side edge of the front side panel, and a second locking mechanism is arranged on the rear side edge of the right side panel and the right side edge of the rear side panel; the front side panel, left side panel, rear side panel, and right side panel are all provided with mesh holes;

Furthermore, a spacer is arranged between the lower edge of the rear side panel and the base.

2. A stove with foldable function as described in claim 1 is characterized in that it further comprises an upper cover plate located on the upper side of the mesh screen, wherein a pair of side edges of the upper cover plate extend downwards with a locking groove adapted to the opening on the upper side of the mesh screen, and a handle extends outwards on a pair of side edges of the upper cover plate.

3. A stove with foldable function as described in claim 2 is characterized in that the length of the front and rear side panels is the same, the length of the left and right side panels is the same, the length of the front side panel is greater than the length of the left side panel, and the front side panel, rear side panel, left side panel, and right side panel form a rectangle.

4. A stove with foldable function as described in claim 1 is characterized in that the ashtray drawer is arranged on the base.

5. A stove with foldable function as described in claim 4 is characterized in that a grip is arranged on the ashtray.

6. A stove with foldable function as described in claim 4 is characterized in that the inner side of the base is equipped with a guide slope corresponding to the ashtray.

7. A stove with foldable function as described in claim 6 is characterized in that the base is equipped with an air inlet.

8. A stove with foldable function as described in claim 2 is characterized in that the base, mesh screen, and upper cover plate are all hardware components.

9. A stove with foldable function as described in claim 8 is characterized in that the first locking mechanism includes a first locking hole arranged on the left side panel, a second hole arranged on the rear side panel, and a first locking pin arranged on the rear side panel that connects the first locking hole and the second locking hole; The second locking mechanism includes a third locking hole arranged on the right side panel, a fourth locking hole arranged on the rear side panel, and a second locking pin arranged on the rear side panel that connects the third locking hole and the fourth locking hole.

* * * * *